US005624237A

United States Patent [19]

Prescott et al.

[11] Patent Number: 5,624,237

[45] Date of Patent: Apr. 29, 1997

[54] PUMP OVERLOAD CONTROL ASSEMBLY

[76] Inventors: Russell E. Prescott; Perrin T. Prescott, both of P.O. Box 339, Exeter, N.H. 03833

[21] Appl. No.: 219,939

[22] Filed: Mar. 29, 1994

[51] Int. Cl.[6] ..... F04B 49/00

[52] U.S. Cl. ..... 417/33; 417/44.2; 417/63; 361/25

[58] Field of Search ..... 417/63, 33, 32, 417/38, 44.2; 361/25

[56] References Cited

U.S. PATENT DOCUMENTS

| | | | |
|---|---|---|---|
| 2,791,736 | 2/1957 | Schaefer | 318/221 |
| 3,794,789 | 2/1974 | Bynum | 200/83 |
| 3,973,877 | 8/1976 | Taki | 417/38 |
| 4,134,566 | 1/1979 | Spitzack | 248/309 R |
| 4,410,924 | 10/1983 | Hewitt et al. | 361/25 |
| 4,462,758 | 7/1984 | Speed | 417/38 |
| 4,502,090 | 2/1985 | Sloan | 361/25 |
| 4,628,236 | 12/1986 | Schaefer | 318/558 |
| 5,244,351 | 9/1993 | Arnette | 417/38 |

FOREIGN PATENT DOCUMENTS

| | | | |
|---|---|---|---|
| 2531795 | 1/1977 | Germany | 361/25 |
| 0879697 | 11/1981 | U.S.S.R. | 361/25 |

*Primary Examiner*—Timothy Thorpe
*Assistant Examiner*—Xuan M. Thai
*Attorney, Agent, or Firm*—Daniel J. Bourque; Kevin J. Carroll

[57] ABSTRACT

A pump overload control assembly is for use with an electric motor driven pump in a water pumping system. The assembly includes a pump overload control device coupled to a fluid responsive switch, thereby forming a pump overload control circuit that interrupts the current flow to the motor in response to an overload of current flow to the motor. The pump overload control device includes a resettable overload protector and indicator mechanism that visually indicates when an overload has occurred and breaks the current flow through the circuit, for example, in response to heat generated from the overload current flow. The fluid responsive switch opens and closes the circuit in response to the fluid being pumped to an external source, for example, when the fluid pressure level falls below or rises above a predetermined pressure level. The pump overload control device further includes a power light, for indicating when power is being supplied to the pump overload control device and a run light, for indicating when current is flowing to the motor. The pump overload control device is mechanically mounted to and supported by the fluid responsive switch.

15 Claims, 5 Drawing Sheets

PUMP OVERLOAD CONTROL ASSEMBLY

BACKGROUND OF INVENTION

This invention relates to a pump overload control for a water supply system; for on/off means of power supply; for shutting off the pump motor in the event that the current to the motor is at a damaging level; to provide protection for the pump motor and pump; to indicate overload, power on and pump run; with novel installation means.

The conventional electrically operated pump in a residential water supply system has motor branch-circuit, short-circuit and ground-fault protection provided by a circuit breaker in the electrical entrance panel of the power source. The circuit breaker is generally rated at 300 percent of full-load current to carry the starting current of the motor without nuisance tripping. The motor is protected against overload by an automatic resetting thermal protector within the motor to prevent dangerous overheating of the motor due to overload and failure to start. This overload protector is generally rated at 115 to 140 percent of full load amps. When the motor load exceeds this predetermined amperage level, and continues to run, the overload protector will heat up, open the motor circuit and stop the motor to stop the heat damage. While the motor is off, the heat dissipates and the motor cools. When the overload protector cools, it automatically resets and restarts the motor, further subjecting it to dangerous overheating.

This automatic reset type overload system has resulted in undue damage to the pump motors and often to pumps in many situations including waterlogged tank, abrasives in water supply, pump running dry, improper electrical power source, and damaged or undersized wiring to name a few. In these situations the motor runs at overload amperages until the overload protector heats up and stops the motor, but once it cools it restarts the motor again. If the overload amperage condition still exists and is not high enough to trip the short-circuit/ground-fault circuit breaker in the entrance panel, the motor is subject to this overload heat up and shut off, cool down and turn on cycle again, and subsequently, over and over again. Hence if this damaging heating/cooling automatic cycle continues unnoticed and the motor continues to draw excessive amperage, up to 300 percent of its full load amps without tripping the circuit breaker, the overload problem becomes severe enough to cause damage or failure to the motor or motor circuit, and consequentially the pump.

Simple prior art controls used to stop this damaging heating/cooling cycle have included a dual element fuse in an enclosure. A dual element fuse can be sized close to the full load current of the motor and provides overload protection that supplements the built-in overload protection of the motor. Now when the motor is subject to overload the fuse blows and stops the motor permanently, not allowing the automatic reset overload protector in the motor to go through its heating/cooling cycle which can damage the pump.

Prior art controls above have been deficient in that: the fuse is not resettable, once it blows it must be replaced; replacement fuses are added expense to purchase and find; the enclosure requires wall mounting and if the pressure switch is mounted seperately on the piping this requires multiple electrical connections, excess wiring and added time and space for installation; if the pressure switch is mounted with the enclosure, special mounting, reinforcement or bracing is required to connect and support the pressure switch to the enclosure; when the pressure switch is mounted with the enclosure, prewiring is limited to load side of fuse to line side of pressure switch, this still leaves multiple electrical connections for installation; when the pressure switch is mounted with the enclosure, special piping to the pressure switch is required for this remote installation. Lastly, these prior art controls do not indicate to the owner what their water pumping system is doing. They do not indicate whether the electrical power source is on; whether the power source is running through the pressure switch to indicate pump run; and when using cartridge type fuses they do not indicate when they open under an overload condition.

SUMMARY OF THE INVENTION

It is an object of this invention to overcome the problems of the prior art and provide a new and improved pump overload control with manual reset overload protection, operation means and signals, and for ease and economy of installation.

In accordance with one embodiment of the present invention, a pump overload control, for use in a water pumping system for; a power switch; protecting the pump motor by disconnecting the electrical circuit to the pump motor in the event that the amp draw exceeds a predetermined overload amperage level; installation on pressure switch or pressure switch installed on it; indication means of, amp draw exceeding the predetermined overload level, power on and pump run; manual reset of the overload protector; ease of installation and field wiring; is provided.

The pump overload control comprises a control box having mounting means for pressure switch mounting or mounting to a pressure switch, an electrical terminal block is located in the box and is adapted to be connected between the power source, the pressure switch and the pump motor. Further located in the box is a power switch, a power light, a manual reset overload protector means with trip indicating means, and a run light all electrically coupled by wiring to the terminal block. The pump overload control is further comprised of a cover.

In accordance with a second embodiment of this invention the pump overload control as above can be further assembled with the pressure switch. This leaves the electrical connection to the terminal block to be adapted between the power source and the pump motor only, further reducing installation and material costs.

OBJECTS AND ADVANTAGES, PRESENT INVENTION

Accordingly, several objects and advantages of the present invention are:

(a) to provide a pump overload control which is prewired for simple field wiring to a single terminal location for line voltage and pump load connections;

(b) to provide a pump overload control that can be mounted to the pressure switch and be supported by the pressure switch and its mounting;

(c) to provide a pump overload control that does not require reinforcing or bracing to connect and support a pressure switch;

(d) to provide a pump overload control with an overload protector sized close to full-load amperes to give maximum overload protection;

(e) to provide a pump overload control with an overload protector that is resettable;

(f) to provide a pump overload control with an overload protector that has an overload indicator;

(g) to provide a pump overload control with an inexpensive overload protector;

(h) to provide a pump overload control with a power on light for ease of simple service diagnosis without special instruments;

(i) to provide a pump overload control with a power to load side of pressure switch light (pump run light) for ease of simple service diagnosis without special instruments;

(j) to provide for a pump overload control to contain part of or all of, but not limited to, the components above;

Further objects and advantages are combined to provide an inexpensive, user friendly pump overload control. One that is easy to install, wire and gives superior thermal responsive resettable overload protection. Also to provide added features which can be used easily and conveniently for a novice to diagnose a service problem with out special instruments. Still further objects and advantages will become apparent from a consideration of the ensuing description and drawing.

BRIEF DESCRIPTION OF THE DRAWINGS

Still further objects and advantages will become apparent from a consideration of the ensuing description with accompanying drawings, wherein.

DETAILED DESCRIPTION OF THE DRAWINGS

Figure 1:
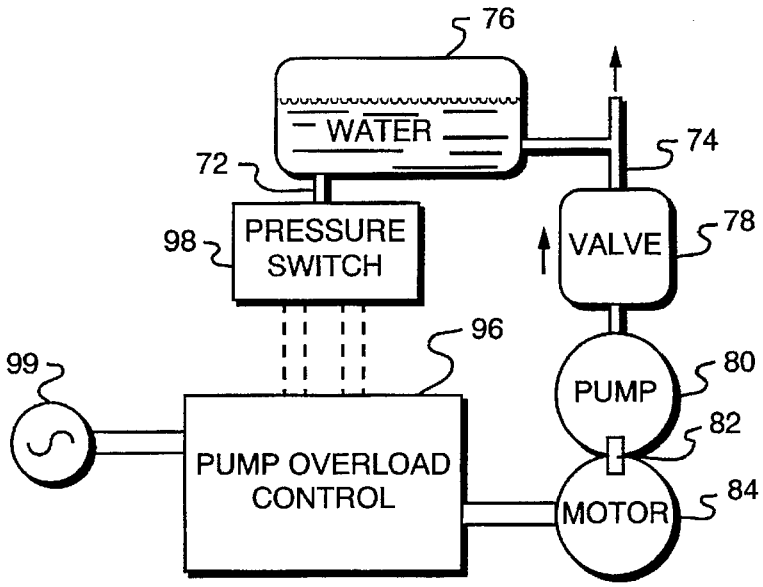
FIG. 1 is a skematic of the present invention in a well pump system.

FIG. 1 shows a water supply system having a pump 80 for pumping water from a well and pressurizing a tank 76 through a pipe 74. A check valve 78 is used in the pipe 74 to prevent the water stored in the tank 76 from returning to the pump 80. The pump 80 is operated by a motor 84 through the coupling 82. A power supply 99, with branch-circuit, short-circuit and ground-fault protection for the motor is connected to the motor 84, through the pressure switch 98. The pressure switch is coupled to the tank 76, by pipe 72, to sense the water pressure within the tank 76. When the water in the tank 76, is used and the water pressure drops below a preset pressure the pressure switch 98, connects the power supply 99, to the motor 84, to drive the pump 80, and refill the tank 76. As the tank 76 fills, the pressure increases to a preset level and the pressure switch 98, disconnects the power supply 99 to the motor 84, and turns the pump 80, off. Adapted for special mounting means and coupled between the source 99, the motor 84, and the pressure switch 98, is the pump overload control 96, of the present invention, to control and sense the current draw and power supply 99, to the motor 84.

Figure 2:
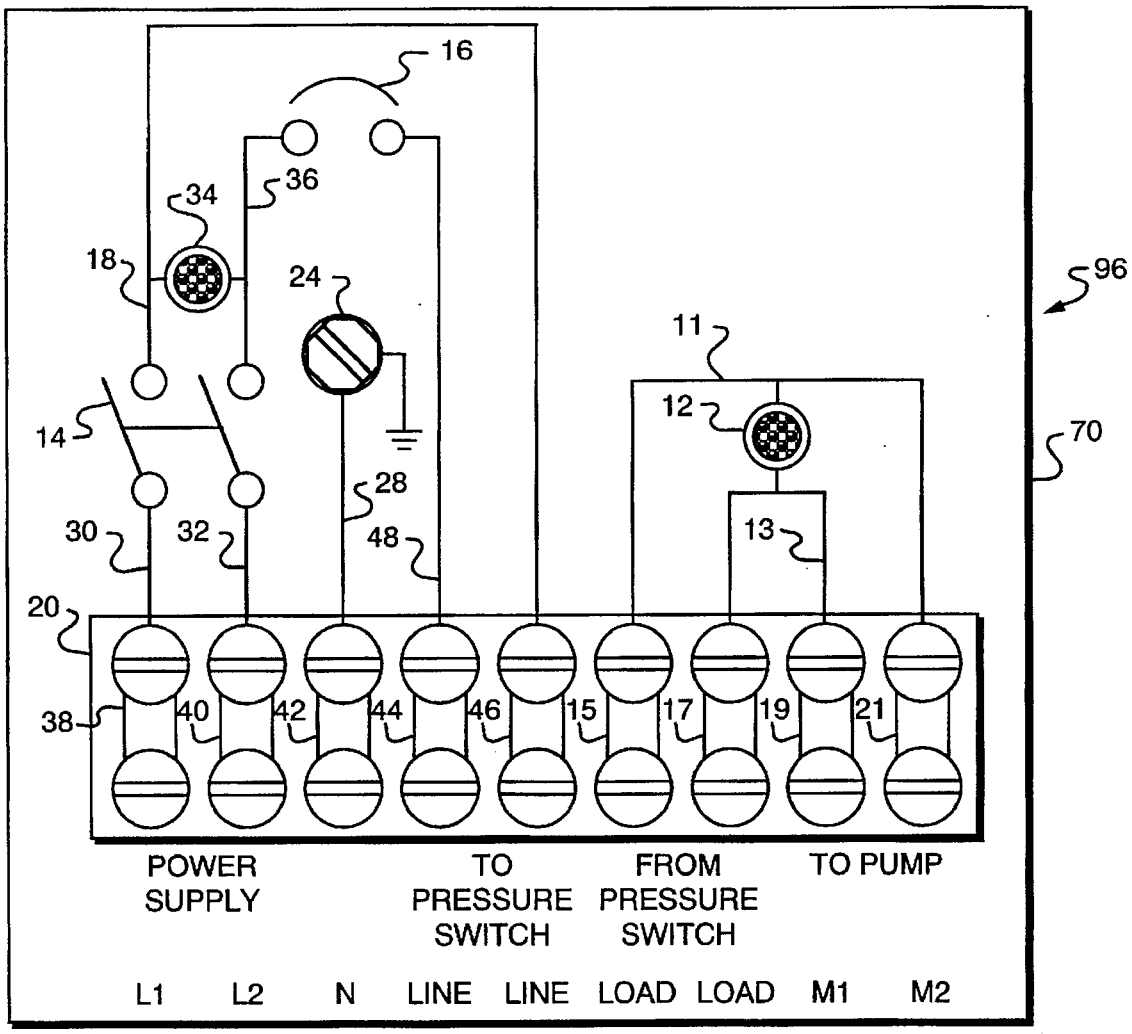
FIG. 2 is a skematic of the component wiring of the present invention.

With reference to FIG. 1, one embodiment of the pump overload control 96, which allows for remote installation from pressure switch is shown in FIG. 2 and generally comprises a terminal block 20, power switch 14, power light 34, manual trip reset overload indicator and protector means 16, and run light 12, electrically connected by wiring, in a control box 70. When power source 99, is connected to the terminal block 20, at terminals 40,42 and 44, and the power switch 14, is on, power flows through conductors 30 and 32, and power switch 14, to conductors 18 and 36, to light the power light 34. The neutral connection at terminal 42 is carried by jumper 28 and fastened to the control box 70, which is preferrably of metal construction, by a screw fastener 24. When the motor 84, is electrically connected to the terminal block 20, at terminals 19, 21 and 42, and the pressure switch 98, is connected to, and responsive to, the pressure in the tank 76, it operates the motor 84, at preselected upper and lower pressure limits to start and stop the pump 80, and light the run light 12, by making and breaking the power circuit through; conductors 36 and 18; overload means 16; conductor 48; to terminals 44 and 46; through pressure switch 98; to terminals 15 and 17; through conductors 11 and 13; to terminals 19 and 21 to motor 84. At the same time, the overload protector 16, will protect the motor 84, from exceeding a predetermined amperage level and permanently stop the motor 84, for overload protection until manually reset.

Figure 3:
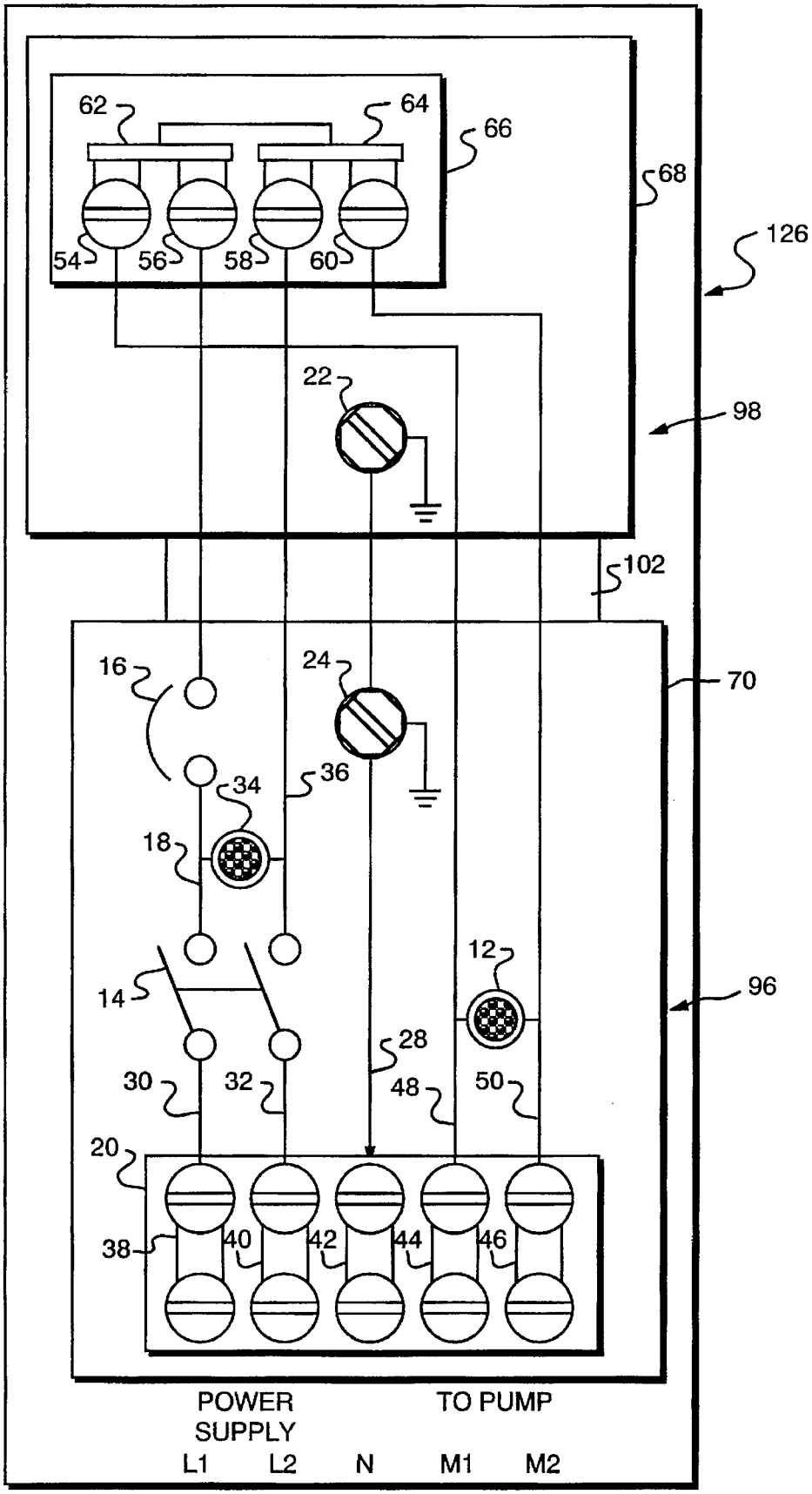
FIG. 3 is a skematic of the component wiring of the present invention directly electrically connected to a pressure switch.

FIG. 3 is an electrical skematic of another embodiment of the present invention labeled as pump overload control assembly 126, showing further assembly of the pump overload control 96, directly electrically connected to pressure switch 98, and attached by mounting connector 102. This embodiment leaves only field wiring of power supply at terminals 38, 40 and 42, and motor load at terminals 42, 44 and 46.

In FIG. 3 the power supply is fastened to terminal block 20 at terminals 38, 40 and 42 respectively. The power switch 14, is connected to the power supply by jumpers 30 and 32, for on/off means of power supply. The ground connection at 42 is carried by jumper 28 and fastened to the control box 70, which is preferrably of metal construction, by a screw fastener 24. The ground connection is further carried by jumper 26 to screw fastener 22 on pressure switch box 68, which is preferrably of metal construction. From the load side of the power switch 14, jumpers 18 and 36 connect the power light 34 to light when power switch 14, is on. Jumper 18 further connects to overload protector 16, for overload protection of motor, overload indication means and manual reset. Jumpers 52 and 36 connect to terminals 56 and 58 of pressure switch 98 respectively, through mounting connector 102. The contact bars 62 and 64 make and break the connection between terminals 56 to 54 and 58 to 60, respectively, in response to the pressure acting on the switch mechanism 66 which is fastened to pressure switch box 68. Jumpers 48 and 50, run through mounting connector 102, and connect terminals 54 and 60 to run light 12, and to terminals 44 and 46 respectively, for connection of pump. The run light 12, lights up when the pressure switch 98, makes the electrical connection for the pump to run.

FIGS. 4, 6, 7 and 9 illustrate the components of the pump overload control 96, with control box 70, and cover 138 fastened to it by screws 144, that encloses the control box 70, and has window 140, allowing access to the power switch 14, overload protector 16, power light 34, run light 12, which are also attached to control box 70.

Figure 4:
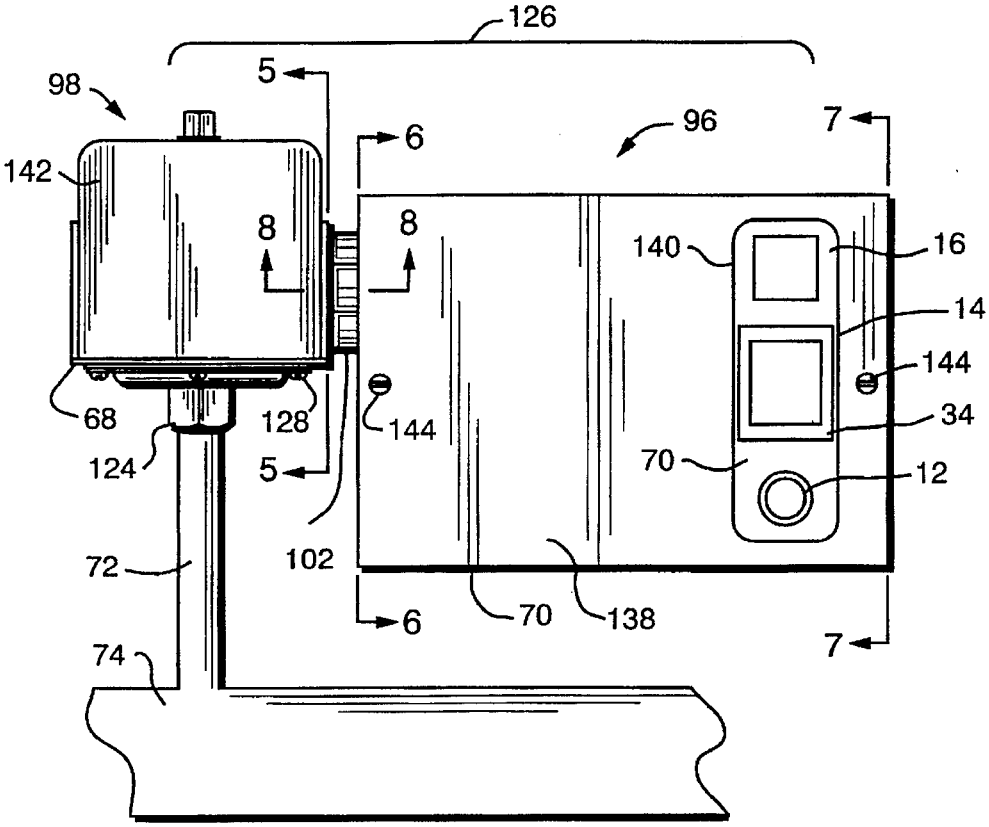
FIG. 4 is a front view of the present invention using mounting connector for the pump overload control to the pressure switch.

FIG. 4 further illustrates one installation of the pump overload control 96, of this invention. Pressure switch support pipe 72, is securely connected to main pipe 74, both preferably of schedule 40 brass construction. Pipe 72 supports the pressure switch 98, cover 142, mounting connector 102 and control 96, when connected to coupling 124 which is attached to pressure switch box 68, by screws 128.

Figure 5:
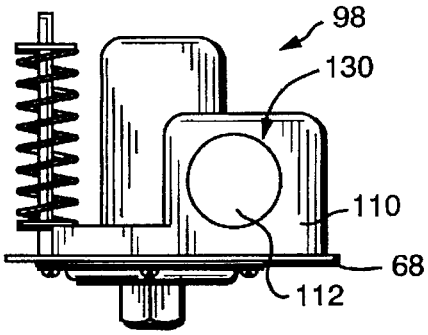
FIG. 5 is section 5—5 of FIG. 4 with pressure switch cover removed, showing mounting connection for pump overload control.
Figure 8:
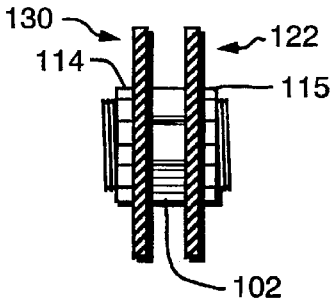
FIG. 8 is section 8—8 of FIG. 4, showing mounting connector for pressure switch and pump overload control.
Figure 6:
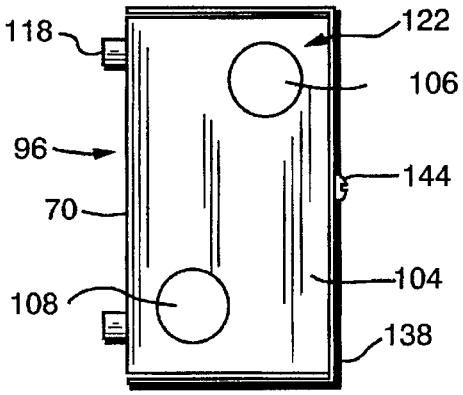
FIG. 6 is section 6—6 of FIG. 4, showing mounting connection for pressure switch.

This installation and pump overload control mounting to the pressure switch is further illustrated in FIGS. 5, 6 and 8, where the pressure switch box 68, has mounting connection 130, for pump overload control, comprised of side wall 110 and hole 112, as shown in FIG. 5. In FIG. 6, control box 70, has mounting connection 122, for pressure switch, comprised of side wall 104 and hole 106. In FIG. 8, mounting connector 102, connects the pressure switch and the pump overload control through their respective mounting connections 130 and 122 by locknuts 114 and 115 respectively. The mounting connector 102, also serves as a conduit for conductors between pump overload control 96, and pressure switch 98, as shown in FIG. 3.

The side wall 104 of control 96, shown in FIG. 6, also has hole 108 for power supply conductors to extend through, as shown in FIG. 1.

Figure 7:
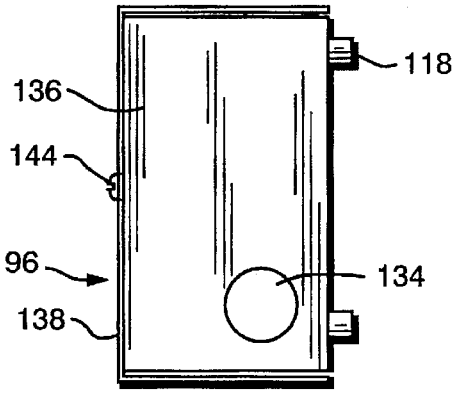
FIG. 7 is section 7—7 of FIG. 4, showing mounting connection for pump overload control.

The side wall 136, of control 96, shown in FIG. 7, has hole 134 for motor conductors to extend through, as shown in FIG. 1.

Figure 9:
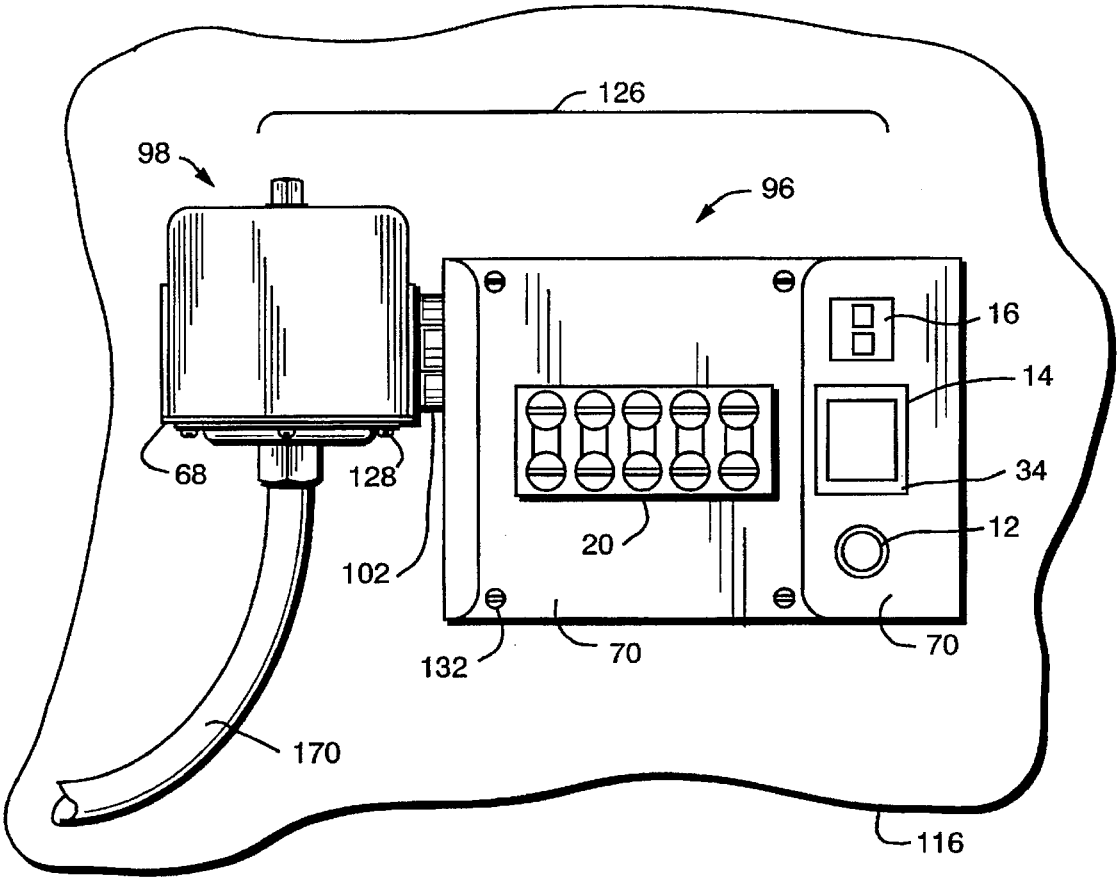
FIG. 9 is a wall mount front view of the present invention with cover off and using mounting connector for the pressure switch to the pump overload control.

FIG. 9 further illustrates another installation of the pump overload control assembly 126, of this invention. Control 96, is securely connected to wall 116, by screws 132, through standoffs 118 as shown in FIGS. 6 and 7. Screws 132, support the control 96, mounting connector 102, and pressure switch 98. Piping 170, is connected to main pipe 74, as in FIG. 4.

This installation and pressure switch mounting is further illustrated in FIG. 8, where mounting connector 102, is fastened to and supported by control mounting connection 122, by lock nut 115. FIG. 8 also shows pressure switch mounting connection 130, fastened to and supported by mounting connector 102, by lock nut 114.

Figure 10:
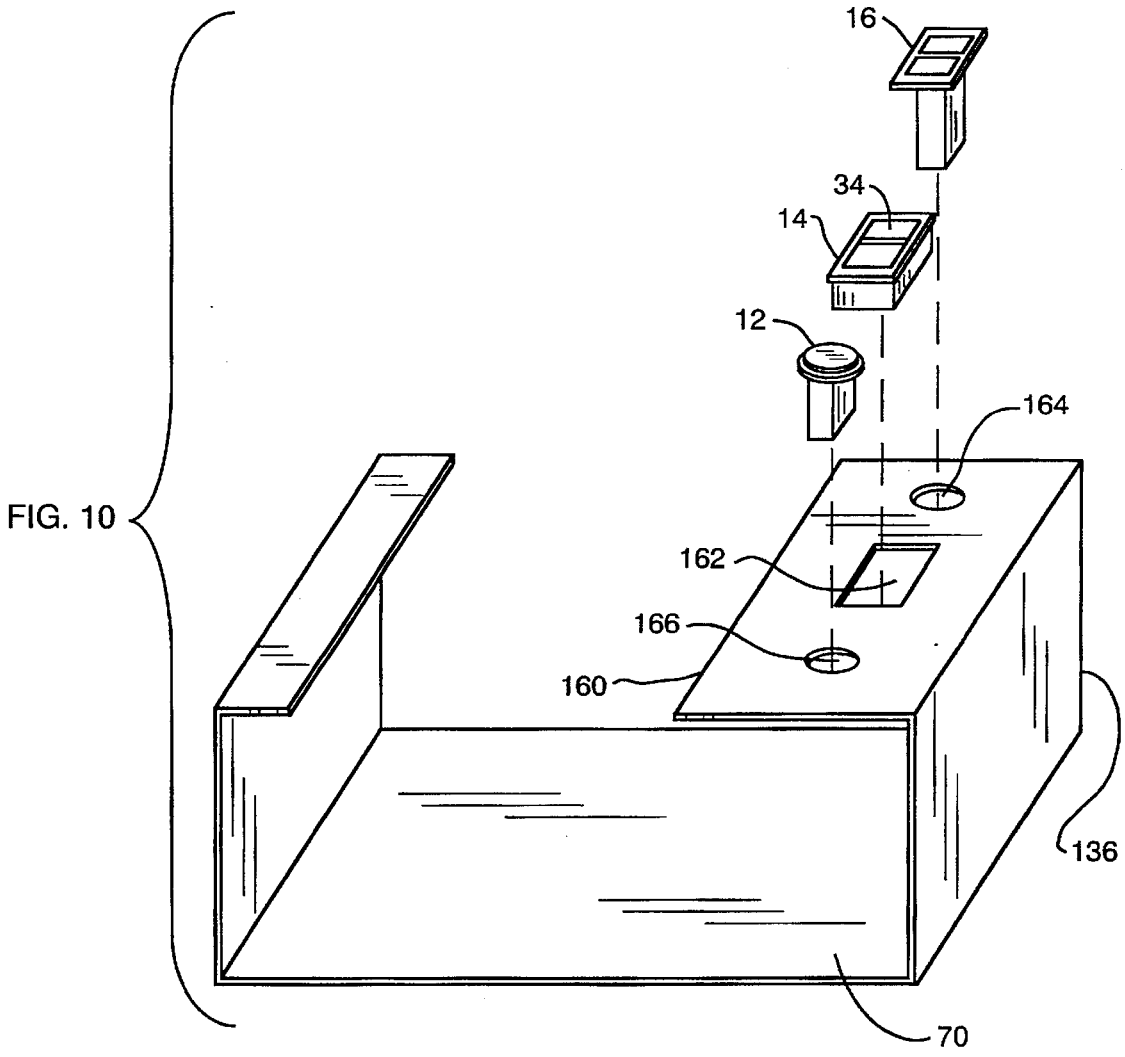
FIG. 10 is an isometric view of the control box.

FIG. 10 is an isometric view of control box 70, in further detail to show typical mounting of power switch 14 with power light 34, overload protector 16, and run light 12 mounted to return top ledge 160, of sidewall 136, of control box 70, through holes 162, 164 and 166 respectively.

The pressure switch 98, described above and pressure switch box 68 may be a standard part such as a model FSG-2 pressure switch manufactured by Square D Company.

The mounting connector 102, described above may be a standard part such as a zinc die cast box spacer catalog #16405 by Adalet/ECM, Cleveland, Ohio.

The overload protector 16, described above may be a standard part such as a thermal circuit breaker model W28 by Potter & Brumfield, Princeton, Ind.

From the description above, a number of advantages of the present invention become evident:

(a) The terminal block in FIG. 3 is the only field wiring necessary.

(b) The mounting connection between the control box and the pressure switch is strong, allowing installation of the pump overload control assembly to pressure switch support pipe only.

(c) The mounting connection between the control box and the pressure switch is strong, allowing the pressure switch to be mounted and supported by the control box only.

(d) FIGS. 3 & 4 show that the pump overload control is less costly, and easier and faster to install; no need for mounting to a wall; no need for extra piping from main pipe to wall mounted switch as in FIG. 9, just attach to pressure switch support pipe.

(e) The on/off switch, power light, overload protector and run light are highly visible and serviceable.

Even further advantages of the present invention will become evident from a consideration of the following operation section.

Operation—FIGS. 2 and 3

The pump overload control of the present invention is wired with line voltage and pump load connections. The on/off switch indicates power on when power on light is lit. Power then flows through the resettable overload protector with overload indicator, to the pressure switch which makes and breaks power to the pump and run light.

If a situation occurs where there is an amperage overload the overload protector will break the line voltage to the pressure switch, pump run light and the pump. The overload protector gives motor overload protection as a dual element fuse but, unlike the fuse, it has a visual trip indicator for easy service diagnosis. Once the overload situation is over, unlike a dual element fuse, the overload protector can simply be reset to once again provide overload protection.

From the above operation a number of advantages of the present invention are evident:

(a) The power on light makes for easy service diagnosis.

(b) The power to pump run light makes for easy service diagnosis.

(c) The pump overload control has superior overload protection compared to the built-in motor overload protector, for it stops the pump until manually reset.

(d) The pump overload control has a visual trip indicator for overload.

(e) The pump overload control has a resettable overload protector.

SUMMARY, RAMIFICATIONS AND SCOPE

Accordingly, the reader will see that the pump overload control of this invention is easy and inexpensive to install, has user friendly indicators for easy monitoring and service of pump system, and protects the pump. Furthermore, this pump overload control has the additional advantages in that it can be installed in a novel way on the support piping to the pressure switch;

it eliminates the added material and labor cost of wall mounting;

its electrical connection and installation is no more than that required for the pressure switch therefore there is no added time or expense for its installation and wiring; and it provides overload protection without the need to replace blown fuses at extra expense.

Although the description above contains many specifications, these should not be construed as limiting the scope of the invention but as merely providing ilustrations of some of the presently preferred embodiments of this invention. For example, the invention can be 115 or 230 volt, single pole or 2-pole, can have other materials of construction, and can incorporate other components such as an electrical disconnect or lockable enclosure, etc. The invention may be used in a variety of applications also, such as utilizing different types of automatic responsive switches like float or flow switches, and using the invention for other types of pumps, including sump, sewage or process pumps. In applications using other types of automatic of automatic switches the electrical connections can be made similar to that of the above described pressure switch connections, therefore retaining the advantages of the present invention.

I claim:

1. A pump overload control circuit, comprising:

at least one current receiving conductor, for receiving current from a power source;

a power switch, coupled between said at least one current receiving conductor and a resettable overload protector;

said resettable overload protector coupled between said power switch and a fluid responsive switch;

said fluid responsive switch coupled between said resettable overload protector and at least one current transmitting conductor, wherein said fluid responsive switch is responsive to fluid contained in an external source; and said least one current transmitting conductor coupled to said fluid responsive switch, for transmitting current to a pump, for forming a pump overload control circuit having a power switch which can shut off power to said fluid responsive switch and said pump.

2. The pump overload control circuit of claim 1, further including a run light coupled between said at least one current transmitting conductor and said fluid responsive switch, wherein said run light indicates current transmission to a pump.

3. The pump overload control circuit of claim 1, further including a power light coupled between said overload protector and said power switch, wherein said power light indicates engagement of said power switch.

4. The pump overload control circuit of claim 1, in which said overload protector is a thermal circuit breaker responsive to thermal overload.

5. The pump overload control circuit of claim 1, in which said fluid responsive switch is a fluid pressure responsive switch responsive to fluid pressure within an external tank.

6. The pump overload control circuit of claim 5, in which said at least one current transmitting conductor is in communication with a motor that is in communication with a fluid pump that pumps fluid to said external tank.

7. A pump overload control assembly, for controlling a supply of power to a pump motor, said pump overload control assembly comprising:

a pump overload control device, including:

at least one electrical current receiving conductor, for receiving current from a power source;

a power switch having at least first and second positions, said power switch electrically coupled to said at least one current receiving conductor, for providing electrical current when said power switch is positioned in one of said at least first and second positions;

a resettable overload protector and indicator mechanism having first and second conditions, said resettable overload protector and indicator mechanism coupled to said power switch and responsive to said electrical current, in said first condition for providing uninterrupted electrical current, in said second condition for indicating that an electrical current overload has occurred and for interrupting electrical current flow through said pump overload control device; and a fluid pressure responsive switch, mechanically and electrically coupled to said pump overload control device, wherein said fluid responsive switch is electrically coupled in series between said resettable overload protector and indicator mechanism and at least one current transmitting conductor adapted to be coupled to a pump motor, for forming a pump overload control circuit between said power source and said pump motor, wherein said fluid pressure responsive switch is adapted to open and close said pump overload control circuit in response to fluid pressure contained in an external source.

8. The pump overload control assembly of claim 7, in which said resettable overload protector and indicator mechanism is a thermal circuit breaker responsive to thermal overload.

9. The pump overload control assembly of claim 7, further including a run light coupled to said at least one current transmitting conductor, wherein said run light is adapted to indicate current being transmitted through said at least one current transmitting conductor.

10. The pump overload control assembly of claim 7, further including a power light coupled between said resettable overload protector and indicator mechanism and said power switch, for indicating one of said first and second positions of said power switch.

11. The pump overload control assembly of claim 7, in which said fluid pressure responsive switch is a fluid pressure switch responsive to fluid pressure within an external tank.

12. The pump overload control assembly of claim 11, wherein said pump overload control device is coupled with a pump motor that is in communication with a water pump that pumps water to said external tank.

13. The pump overload control assembly of claim 7, further including a connecting member, for mechanically mounting said pump overload control device to said fluid responsive switch.

14. The pump overload control assembly of claim 13, further including a supporting member extending from a base support said fluid responsive switch, whereby said pump overload control device is completely supported by said connecting member.

15. The pump overload control assembly of claim 7, in which said fluid responsive switch is a fluid detector responsive to a fluid level in an external fluid reservoir.

* * * * *